US005464736A

United States Patent [19]

Helber et al.

[11] Patent Number: 5,464,736

[45] Date of Patent: Nov. 7, 1995

[54] PHOTOGRAPHIC ELEMENTS CONTAINING PARTICULAR SENSITIZING DYES

[75] Inventors: Margaret J. Helber, Rochester; Thomas R. Dobles, Hilton; Donald R. Diehl, Rochester; Heidi E. Dankosh, Rochester; John D. Mee, Rochester, all of N.Y.

[73] Assignee: Eastman Kodak Company, Rochester, N.Y.

[21] Appl. No.: 234,744

[22] Filed: Apr. 28, 1994

[51] Int. Cl.[6] ..... G03C 1/12

[52] U.S. Cl. ..... 430/581; 430/584; 430/587; 430/594

[58] Field of Search ..... 430/595, 584, 430/598, 592, 594, 581, 590

[56] References Cited

U.S. PATENT DOCUMENTS

| | | | |
|---|---|---|---|
| 2,926,187 | 2/1960 | Melby | 260/465 |
| 3,666,477 | 5/1972 | Goffe | 96/114.1 |
| 3,679,422 | 7/1972 | de Mauriac et al. | 96/107 |
| 3,719,495 | 3/1973 | Lea | 96/114.1 |
| 3,761,279 | 9/1973 | de Mauriac et al. | 96/114.1 |
| 4,435,499 | 3/1984 | Reeves | 430/350 |
| 4,751,176 | 6/1988 | Pham | 430/619 |
| 4,803,150 | 2/1989 | Dickerson et al. | 430/502 |
| 4,855,221 | 8/1989 | Factor et al. | 430/510 |
| 4,857,446 | 8/1989 | Diehl et al. | 430/510 |
| 4,861,700 | 8/1989 | Shuttleworth et al. | 430/517 |
| 4,900,652 | 2/1990 | Dickerson et al. | 430/502 |
| 4,900,653 | 2/1990 | Factor et al. | 430/522 |
| 4,923,788 | 5/1990 | Suttleworth et al. | 430/507 |
| 4,940,654 | 7/1990 | Diehl et al. | 430/522 |
| 4,948,717 | 8/1990 | Diehl et al. | 430/510 |
| 4,948,718 | 8/1990 | Factor et al. | 430/522 |
| 4,950,586 | 8/1990 | Diehl et al. | 430/507 |
| 4,952,553 | 8/1990 | Kanot et al. | 503/227 |
| 4,988,611 | 1/1991 | Anderson et al. | 430/494 |
| 5,055,387 | 10/1991 | Diehl et al. | 430/591 |
| 5,213,956 | 5/1993 | Diehl et al. | 430/522 |

FOREIGN PATENT DOCUMENTS

| | | |
|---|---|---|
| 0294099 | 5/1988 | European Pat. Off. . |
| 0391405 | 10/1990 | European Pat. Off. . |
| 60-226555 | 11/1985 | Japan . |
| 61-103862 | 5/1986 | Japan . |
| 61-281156 | 12/1986 | Japan . |
| 862443 | 3/1961 | United Kingdom . |

OTHER PUBLICATIONS

Hennig et al., Z. Chem., 29, 168 (1989).

Chemical Abstract 130793r, vol. 109, No. 16, 17 Oct. 1988.

*Primary Examiner*—Thorl Chea

*Attorney, Agent, or Firm*—Gordon M. Stewart

[57] ABSTRACT

A photographic element having a silver halide emulsion sensitized by dye of the formula I:

I wherein:

$R^1$ represents a substituted or unsubstituted aromatic or heteroaromatic group, a substituted or unsubstituted alkyl or H;

$R^2$ represents a substituted or unsubstituted alkyl, alkenyl, aryl, aralkyl, or H;

$E^1$ represents an electron withdrawing group;

Z represents the non-metallic atoms required to complete a substituted or unsubstituted ring system containing at least one 5- or 6-membered heterocyclic nucleus;

$L^1$, $L^2$, $L^5$ and $L^6$ independently represent a substituted or unsubstituted methine;

m may be 0, 1, 2 or 3;

n may be 0 or 1.

20 Claims, No Drawings

PHOTOGRAPHIC ELEMENTS CONTAINING PARTICULAR SENSITIZING DYES

FIELD OF THE INVENTION

This invention relates to photographic elements containing a silver halide emulsion sensitized by a sensitizing dye of a particular class.

BACKGROUND OF THE INVENTION

Photographic elements employ emulsions consisting of small crystals of silver halide grains suspended in a colloidal polymeric matrix, typically gelatin. Silver halide crystals are semi-conductors, and inherently absorb light in the blue region of the visible spectrum. Sensitivity to all regions of the light spectrum (which term is used here to include infra-red) may be imparted to silver halide crystals by adsorbing spectral sensitizing dyes to the silver halide crystals. Spectral sensitizing dyes are designed to absorb light in specific regions of the spectrum. This feature is useful in photographic elements which have one or more emulsion layers sensitive to the same region of the spectrum (for example, black and white or X-ray elements). More particularly though, it allows color films with three channels to be constructed, where each channel is sensitive to one of the three regions of visible light—blue, green, or red.

Desirable properties of sensitizing dyes include a strong affinity to adsorb to a silver halide surface, and the ability to sensitize efficiently the silver halide grain to specific portions of the spectrum. It is also desirable that the dyes be removed from film during processing to prevent undesirable dye stain in the processed film. Most typical spectral sensitizing dyes are members of the cyanine and related dye classes, often bearing solubilizing groups such as sulfo or carboxylate groups. Sensitizing dyes which absorb red light are typically carbocyanines or merodicarbocyanines; complex cyanines and complex merocyanines may also be used. The solubilizing groups are present to aid dissolution of the dye for coating on silver halide, and removal during processing. Many of the typical red spectral sensitizing dyes used in silver halide systems leave dye stain in part because they are or become colored, and are not fully removed during processing.

In addition to dye stain, another undesirable photographic feature which accompanies the use of spectral sensitizing dyes is a phenomenon called desensitization. Desensitization is described in the text *The Theory of the Photographic Process*, T. H. James, editor, 4th Edition, Macmillan, New York, 1977. Generally, the adsorption of a sensitizing dye to a silver halide grain may reduce the efficiency of the intrinsic response of the grain to blue light; a concomitant loss of efficiency of the spectrally sensitized response also occurs. The effect increases as the amount of adsorbed dye increases. Dyes vary in the extent of desensitization caused at a given dye load, but all dyes will desensitize when adsorbed at sufficiently high levels. Desensitization is undesirable in conventional photographic systems. By reducing the efficiency with which photons are converted to developable latent image, the effectiveness with which the sensitized emulsion may be employed in a photographic element is also reduced.

In contrast to sensitizing dyes described above, filter dyes are used in photographic films and paper to absorb light which would adversely impact the coated silver halide emulsions. Applications of photographic filter dyes include interlayer light filtration, i.e., the traditional yellow filter dyes and magenta trimmer dyes, and intralayer light filtration. Filter dyes generally must be coated at much higher levels than sensitizing dyes to perform their desired function. Functionalization of dyes with solubilizing groups is frequently not sufficient to fully remove them from film during processing. For this reason, filter dyes which must be removed from the film upon processing are designed to be bleachable or decolorizable under processing conditions. One class of useful filter dyes is that described in U.S. Pat. No. 5,213,956. However, the dyes of that patent were solely described for use as filter dyes.

The structural features of the dyes designed for spectral sensitization often exclude them from performing practically as filter dyes and vice versa. Traditionally, different dye classes and structures have been employed in photographic systems to achieve the separate tasks of spectral sensitization and light filtration.

Hence, it would be highly advantageous to design sensitizing dyes which effectively sensitize silver halide emulsions as traditional sensitizing dyes do, yet decolorize upon processing as many traditional filter dye structures do. Additionally, it would be a useful if sensitizing dyes could be found which desensitized to a lesser extent when coated at equal levels than dyes which are customarily used in the practice of spectral sensitization of silver halide emulsions.

SUMMARY OF THE INVENTION

The present invention therefore provides a photographic element comprising a a silver halide emulsion sensitized by dye of the formula I:

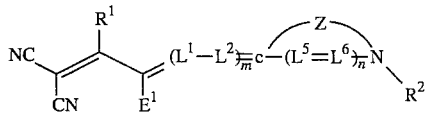

I wherein:

$R^1$ represents a substituted or unsubstituted aromatic or heteroaromatic group, a substituted or unsubstituted alkyl or H;

$R^2$ represents a substituted or unsubstituted alkyl, alkenyl, aryl, aralkyl, or H;

$E^1$ represents an electron withdrawing group;

Z represents the non-metallic atoms required to complete a substituted or unsubstituted ring system containing at least one 5- or 6-membered heterocyclic nucleus;

$L^1$, $L^2$, $L^5$ and $L^6$ independently represent a substituted or unsubstituted methine;

m may be 0, 1, 2 or 3;

n may be 0 or 1.

The above dyes of formula I advantageously function as spectral sensitizing dyes. These dyes additionally have the highly useful property of being decolorizable in photographic processing solutions as are customarily used in the photographic industry. Such solutions are described in the text *Theory of the Photographic Process, 4th Edition*, cited above, and in *Research Disclosure I*, mentioned below. Thus such dyes tend to produce low dye stain. Additionally, the preferred dyes of this invention achieve efficient spectral sensitization while causing little or no emulsion desensitization, and also can exhibit good keeping characteristics (that is, low loss of speed at a wavelength at which they sensitize following storage).

EMBODIMENTS OF THE INVENTION

The aromatic or heteroatomatic group of $R^1$ may be, for example, phenyl, napthyl or furyl, or a moiety such as a pyrrole, pyridine, or thiophene and the like, preferably of from 6 to 14 carbon atoms, any of which may be substituted or unsubstituted. Alkyl groups for $R^1$ may particularly be from 1 to 12 carbon atoms and include cylcloalkyl groups, any of which may be substituted or unsubstituted (and thus a substituted alkyl includes particularly, aralkyl groups). "Group" wherever used in the present application includes the possibility of being substituted or unsubstituted alkyl, aryl, and alkenyl groups as well as appropriate substitutents for use on these alkyl, aryl and aralkyl groups are further illustrated in the last paragraph of this section.

$R^2$ represents a substituted or unsubstituted group such as alkyl, aralkyl, alkenyl, aryl, and the like.

Z represents the non-metallic atoms required to complete a substituted or unsubstituted ring system containing at least one 5- or 6-membered heterocyclic nucleus. The 5- or 6-membered heterocycle represented by the atoms in Z can be fused with additional substituted or unsubstituted rings such as a benzo or naptho ring. Suitable heterocyclic nuclei are of the type commonly used in sensitizing dyes and are well known in the art. Many are described, for example, in James, *The Theory of the Photographic Process,* 4th Edition, pages 195–203. Useful heterocyclic nuclei include thiazole, selenazole, oxazole, imidazole, indole, benzothiazole, benzindole, naphthothiazole, naphthoxazole, benzimidazole, and the like. In a preferred embodiment, Z represents the atoms required to complete a substituted or unsubstituted benzoxazole or benzothiazole nucleus. m may be 0,1, or 2. n may be 0 or 1. In a preferred embodiment, m=2 and n=0.

$L^1$ through $L^2$ each individually represent a methine group which may be substituted or unsubstituted. Substituents on $L^1$ through $L^2$ may include a substituted or unsubstituted alkyl, alkenyl, aryl, aralkyl, halogen, acetoxy, or cycloalkyl group. The foregoing includes the possibility that any of them may be members of a 5 or 6-membered ring. Any of the $L^1$ and $L^2$ may be members of a substituted or unsubstituted carbocyclic or heterocyclic ring (particularly a 5- or 6-membered ring of either type), such as cyclopentyl, cyclohexyl, and the like. It will be understood that this possibility is within the definition of substituted methines ("substituted" methines being included in the term "group" in reference to methines, as previously discussed). For example, when m=1, and particularly when m>1, $L^1$ through $L^2$ can be members of any of the foregoing types of rings and are therefore considered "substituted".

As for $E^1$, electron withdrawing substituents are discussed in March, *Advanced Organic Chemistry*, pages 20–21, 228–229, 386–387, 494–497. In particular, preferred electron withdrawing substituents would have a Hammett $\sigma_p$ constant of greater than 0.1 and preferably between 0.1 and 1.0 (for example, between any of 0.3, 0.4, 0.5 or 0.6 and 1.0). Hammett $\sigma_p$ values are discussed in *Advanced Organic Chemistry* 3rd Ed., J. March, (John Wiley Sons, NY; 1985). Note that the "$_p$" subscript refers to the fact that the σ values are measured with the substituents in the para position of a benzene ring. Additional tables relating to Hammett $\sigma_p$ constants can be found in *Chemical Reviews* Volume 91, pages 165–195 (authored by C Hansch et al.). Groups for $E^1$ may include cyano (which is preferred), acyl, benzoyl, phenacyl, aminocarbonyl, alkoxycarbonyl, aryl, or alkylsulfonyl group (any of which particularly may have 2 to 20, and preferably of 2 to 8, carbon atoms), or an arylsulfonyl or any sulfamoyl group (either particularly including those of 1 to 8, and preferably 1 to 20, carbon atoms).

Particular formulae of dyes of formula I above then, include dyes of formula Ia below:

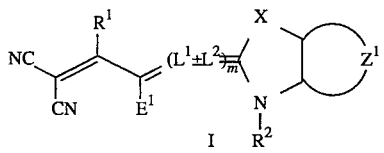

Ia wherein X is O, N, S, Se, Te and $Z^1$ represents the atoms necessary to complete a substituted or unsubstituted benzo or naptho ring.

More particularly, sensitizing dyes of formula I include those of formula Ib below:

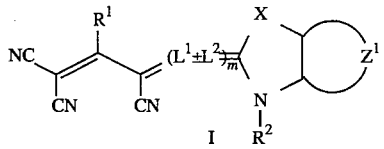

Ib.

In the above formula Ib then, X is O or S and $Z^1$ represents the atoms necessary to complete, together with the oxazole or thiazole ring, a substituted or unsubstituted benzoxazole, naphthoxazole, benzothiazole, naphthothiazole, or benzimidazole nucleus.

Preferably dyes of formula I have at least one acid or acid salt group, such as a carboxy, sulfonamido, sulfamoyl, sulfato or sulfo substituent. This may particularly be on $R^2$, and even more particularly $R^2$ may be an alkyl group substituted with such an acid or acid salt group ($R^2$ may particularly be a sulfoalkyl group, such as sulfomethyl, sulfoethyl, sulfopropyl, of sulfobutyl).

Any of the alkyl groups described above include cycloalkyl. Examples of any of the alkyl groups mentioned above are methyl, ethyl, propyl, isopropyl, butyl, isobutyl, t-butyl, pentyl, hexyl, octyl, 2-ethylhexyl, and the like. Particular cycloalkyl groups can be cyclopentyl, cyclohexyl, 4-methylcyclohexyl, and the like. Alkenyl groups can be vinyl, 1-propenyl, 1-butenyl, 2-butenyl, and the like. Aryl groups can be phenyl, naphthyl, styryl, and the like. Aralkyl groups can be benzyl, phenethyl, and the like. Useful substituents on any of the foregoing or other groups disclosed include halogen, alkoxy, acyl, alkyl, alkoxycarbonyl, aminocarbonyl, carbonamido, carboxy, sulfamoyl, sulfonamido, sulfo, nitro, hydroxy, amino, cyano, trifluoromethyl and the like. For example, $R^1$ could be a 5 or 6 membered aromatic (for example, phenyl) or heteroaromatic ring which is unsubstituted or substituted by any of the foregoing substituents other than halogen or other than chloro. Also, $Z_1$ could be substituted by any of the foregoing described substituents (including a 5 or 6 membered heterocyclic ring such as pyrrole, thiophene, furan, pyridine, and the like).

Silver halide emulsions sensitized with a dyes of formulae I, Ia or Ib may parituclarly have a maximum sensitivity between 570–700 nm and more particularly may have a maximum sensitivity in the red region of 600–700 nm (and more particularly, in the 610–670 nm or even 610 to 640 or 650 nm).

Dyes of formula I may particularly be prepared by the methods described in detail, particularly in U.S. Pat. No. 5,213,956.

Examples of dyes of the present invention include the following:

TABLE 1
Tricyanopropene Merocyanine Spectral Sensitizing Dyes
Dye 1
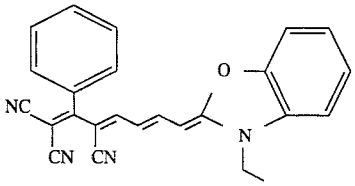
Dye 2
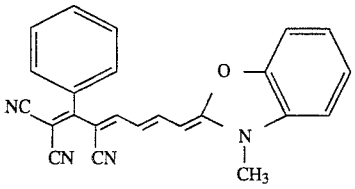
Dye 3
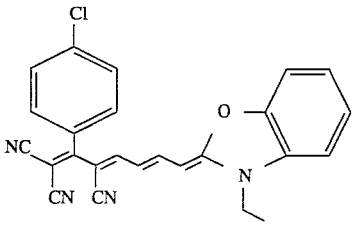
Dye 4
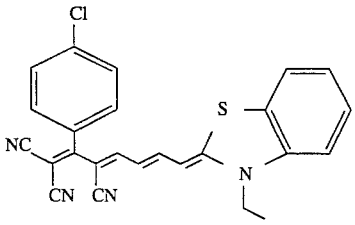
Dye 5
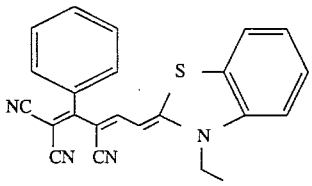
Dye 6
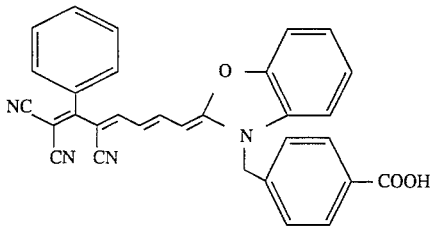
Dye 7
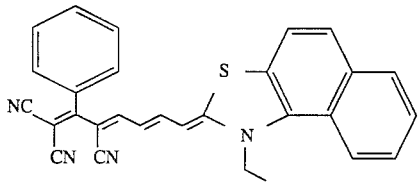
TABLE 1-continued
Tricyanopropene Merocyanine Spectral Sensitizing Dyes
Dye 8
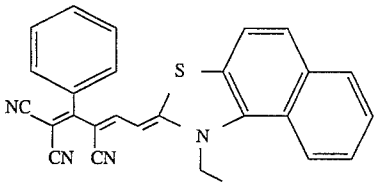
Dye 9
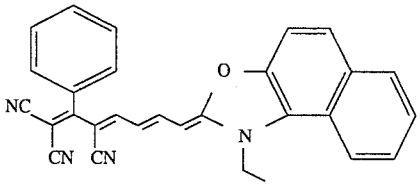
Dye 10
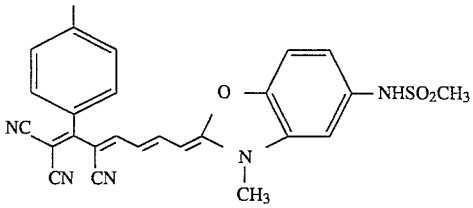
Dye 11
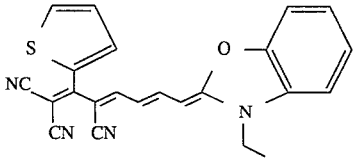
Dye 12
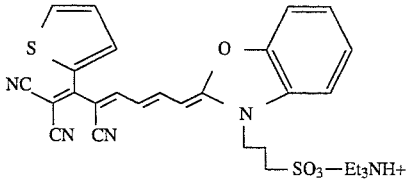
Dye 13
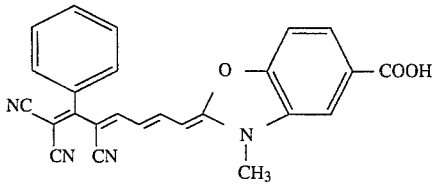
Dye 14
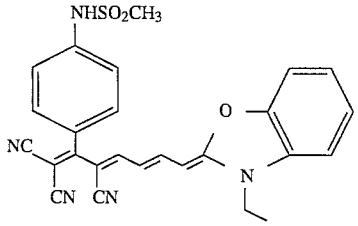
Dye 15
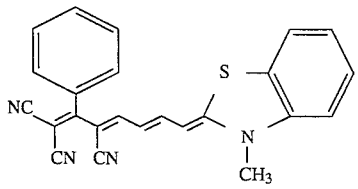

TABLE 1-continued
Tricyanopropene Merocyanine Spectral Sensitizing Dyes
Dye 16
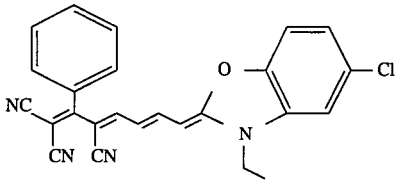
Dye 17
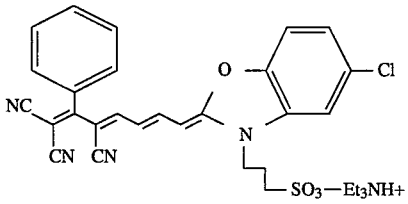
Dye 18
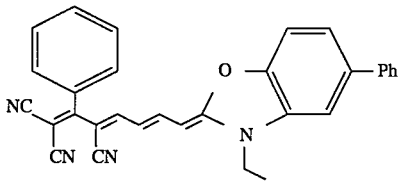
Dye 19
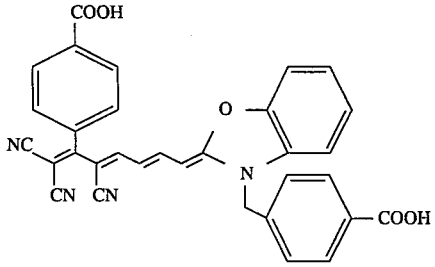
Dye 20
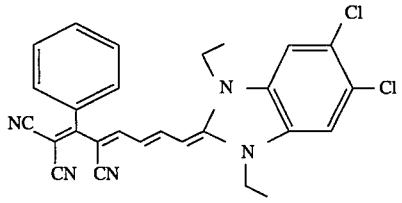
Dye 21
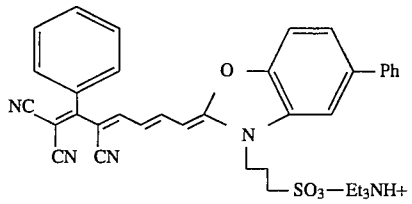
Dye 22
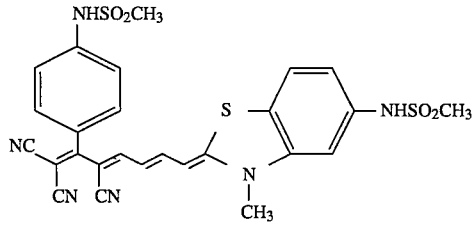
TABLE 1-continued
Tricyanopropene Merocyanine Spectral Sensitizing Dyes
Dye 23
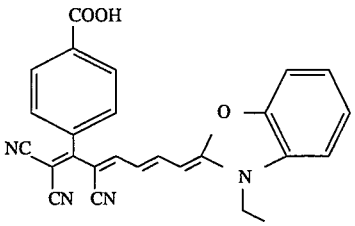
Dye 24
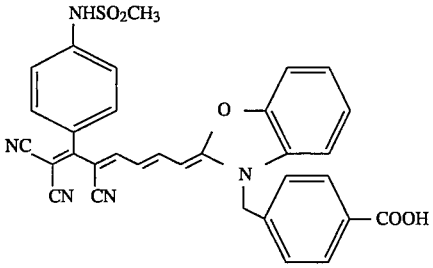
Dye 25
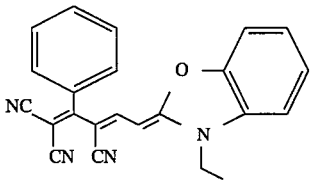
Dye 26
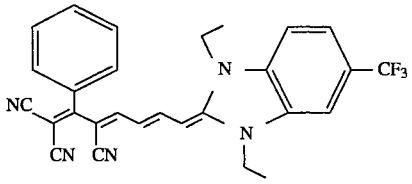
Dye 27
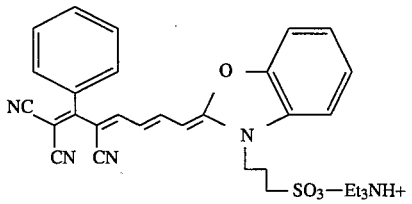
Dye 28
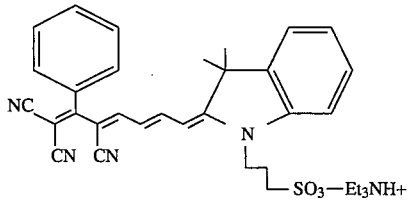

TABLE 1-continued

Tricyanopropene Merocyanine Spectral Sensitizing Dyes

Dye 29

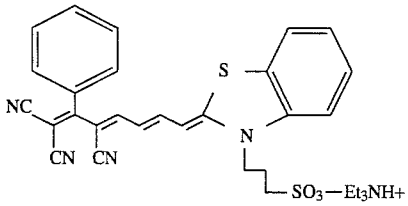

Dye 30

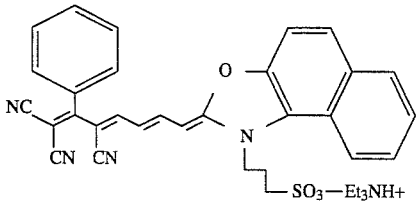

Dye 31

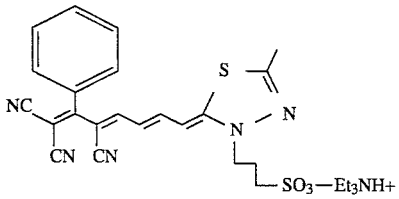

Dye 32

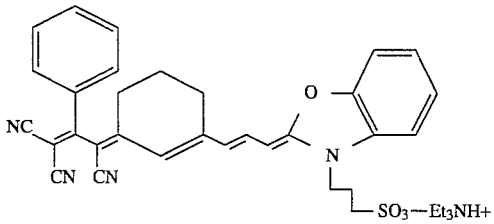

Dye 33

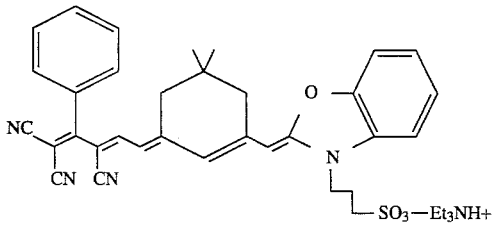

The photographic elements of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, with the reverse order on a reflective support being typical.

In the following discussion of suitable materials for use in elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I. The foregoing reference and any other reference cited herein are incorporated by reference in their entirety.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

With negative working silver halide a negative image can be formed. Optionally a positive (or reversal) image can be formed.

The photographic elements of the present may also use colored couplers (e.g. to adjust levels of interlayer correction) and masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-78,230; 90-079,336; 90-079,338; 90-079,690; 90-79,691; 90-080,487; 90-080,489; 90-080,490; 90-80,491; 90-080,492; 90-080,494; 90-085,928; 90-86,669; 90-086,670; 90-087,361; 90-087,362; 90-87,363; 90-087,364; 90-088,096; 90-088,097; 90-93,662; 90-093,663; 90-093,664; 90-093,665; 90-93,666; 90-093,668; 90-094,.055; 90-094,056; 90-101,937; 90-103,409; 90-151,577.

The silver halide used in the photographic elements of the present invention may be silver iodobromide, silver bromide, silver chloride, silver chlorobromide, silver chloroiodobromide, and the like. The type of silver halide grains preferably include polymorphic, cubic, and octahedral. The grain size of the silver halide may have any distribution known to be useful in photographic compositions, and may be ether polydipersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process*. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure*, June 1975, item 13452 and U.S. Pat. No. 3,772,031.

The silver halide may be sensitized by sensitizing dyes of formula I by any method known in the art, such as described in *Research Disclosure I*. Of course, various layers of photographic elements of the present invention may use sensitizing dyes other than those of formula I, but a dye of formula I will be present in at least one layer as a sensitizing dye. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours). The same dye of formula (I) which is present in an element of the present invention to sensitize a silver halide emulsion, will not also be present as a solid particle filter dye. Typical amounts of dye of the present invention which would be present to sensitize a silver halide emulsion, range from 0.1 to 5 millimoles of dye per mole of silver halide (mmoles/mole). Preferably, the total amount would be between 0.5 mmoles/mole to 3 mmoles/mole.

Photographic elements of the present invention are preferably imagewise exposed using any of the known techniques, including those described in *Research Disclosure I*, section XVIII. This typically involves exposure to light in the visible region of the spectrum.

Photographic elements comprising the composition of the invention can be processed in any of a number of well-known photographic processes utilizing any of a number of well-known processing compositions, described, for example, in *Research Disclosure I*, or in James, *The Theory of the Photographic Process* 4th, 1977. In the case of processing a reversal color element, the element is first treated with a black and white developer followed by fogging of the silver halide (chemically or by light), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

The invention is described further in the following examples.

EXAMPLES

Various of the above described merocyanine dyes of formula I were synthesized in accordance with the procedure of U.S. Pat. No. 5,213,956 to Diehl et al. (issued May 25, 1993, and entitled Solid Particle Dispersions of Filter Dyes for Photographic Elements. Absorbance maxima (indicated by "λmax") of various of those dyes was then measured in a methanol solution, and the results listed below in Table 3:

TABLE 3

Methanol solution absorbance maxima of representative examples of tricyanopropene merocyanine dyes

| Dye No. | λ max | Dye No. | λ max |
|---|---|---|---|
| 1 | 591 nm | 18 | 599 nm |
| 2 | 590 nm | 20 | 562 nm |
| 3 | 593 nm | 21 | 599 nm |
| 4 | 648 nm | 22 | 602 nm |
| 7 | 650 nm | 23 | 594 nm |
| 8 | 547 nm | 24 | 599 nm |
| 11 | 602 nm | 25 | 498 nm |
| 12 | 602 nm | 27 | 592 nm |
| 14 | 592 nm | 29 | 629 nm |
| 16 | 599 nm | 30 | 603 nm |

Further characteristics of some of the dyes of the present invention were then evaluated. Various of the dyes A to K below, were used as comparative dyes in the Examples below:

TABLE 1A

Comparative Dyes

A

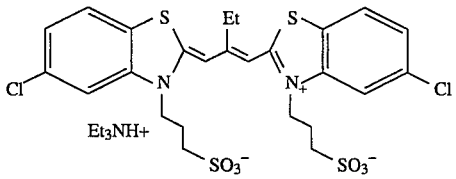

B

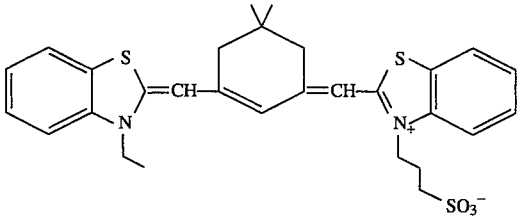

C

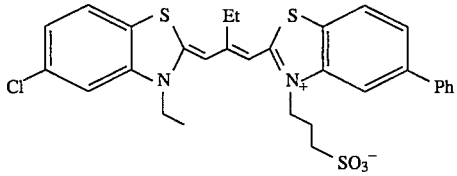

D

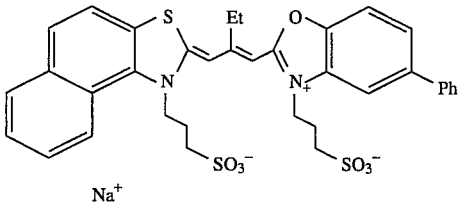

E

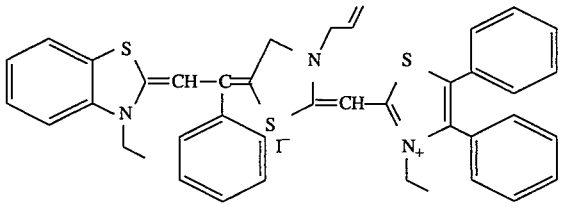

F

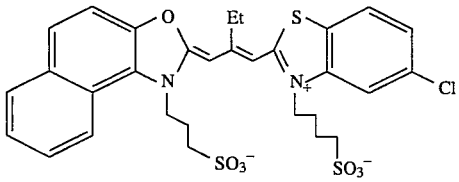

G

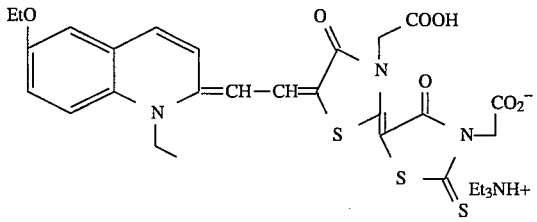

TABLE 1A-continued

Comparative Dyes

H

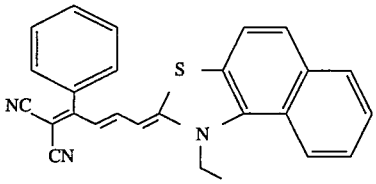

I

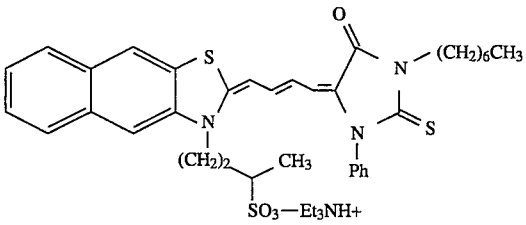

J

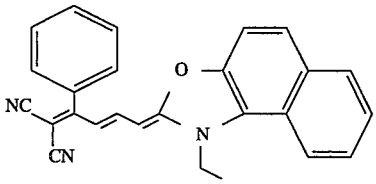

K

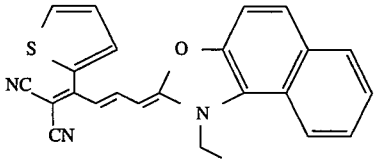

Example 1: Sulfite Bleachability

To demonstrate the bleachability of the subject dyes by sulfite ion, representative examples of the inventive and comparative dyes were dissolved in dimethylformamide to give an optical density of ~2, then diluted with an equal volume of distilled water. A 1 cm spectrophotometric cell (volume~3 mL) was filled with this dye solution and its absorbance spectrum recorded. Three drops of a saturated aqueous solution of sodium sulfite was added, and the cell contents were thoroughly mixed. The solution absorbance spectrum was again recorded after an elapsed time of 5 seconds. The results of the experiments are recorded in Table 4

TABLE 4

| Dye | Reduction in optical density at λ max 5 sec after addn. of sulfite |
|---|---|
| Inventive Dye 1 | 100% |
| Inventive Dye 12 | 100% |
| Inventive Dye 25 | 100% |
| Inventive Dye 27 | 100% |
| Inventive Dye 28 | 100% |
| Inventive Dye 29 | 100% |
| Inventive Dye 30 | 100% |
| Inventive Dye 31 | 100% |
| Comparative Dye A | <5% |
| Comparative Dye B | <5% |
| Comparative Dye C | <5% |
| Comparative Dye D | <5% |
| Comparative Dye E | <5% |
| Comparative Dye F | <5% |
| Comparative Dye G | <5% |

TABLE 4-continued

| Dye | Reduction in optical density at λ max 5 sec after addn. of sulfite |
|---|---|
| Comparative Dye H | <5% |
| Comparative Dye I | <5% |
| Comparative Dye J | <5% |
| Comparative Dye K | <5% |

In every case, the inventive dyes bleached rapidly, leaving a colorless solution within 5 seconds, while the comparative dyes lost little or no density at λmax. The comparative examples were observed again after 30 minutes and showed little or no evidence of further bleaching. The inventive dyes clearly possess superior decolorization properties in the presence of sulfite ion as compared with typical red spectral sensitizers represented by the comparative examples. This property would be particularly advantageous in low replenishment rate developer solutions where excessive concentrations of dissolved dyes may precipitate causing processing blemishes unless the dyes are decolorized and destroyed.

Example 2: Emulsion Sensitization

In this example, photographic elements were made which contained the comparative and inventive sensitizing dyes adsorbed to a cubic AgBrI emulsion.

The emulsion was precipitated as a monodisperse distribution of 0.2 υm equivalent spherical diameter crystals of predominantly cubic morphology. The Br/I ratio was 97.4/2.6.

The emulsion was chemically sensitized with thiocyanate, sulfur, and gold with heating as is known to those skilled in the art. The chemical sensitizers used were NaSCN at 44 mg/mole Ag, $Na_2S_2O_3.5H_2O$ at 33 mg/mole Ag, and $KAuCl_4$ at 6.6 mg/mole Ag; heat was provided using a constant temperature bath at 70° C.

Photographic melts were prepared for coating using the emulsion described above, and surfactant (saponin, a naturally occurring glycoside, at 0.11% of the melt by mass), gelatin (at 4.8% of the melt by mass), solutions or slurries of the sensitizing dyes (to be described below), and water. Immediately prior to coating, the hardener 1,1'-(oxybis(methylene-sulfonyl))bis-ethene1,1'-(oxybis(methylene-sulfonyl))bis-ethene was added at 0.08% by mass of the final melt.

The dyes were added at a level of 0.0008 moles of dye/mole Ag, from either methanol solutions or slurries, or from 2% phenoxyethanol in methanol solutions or slurries, with the organic solvent comprising 11.8% of the melt by mass.

These photographic melts were coated on a mechanical extrusion coating machine on an ESTAR base at a total laydown of 152.84 g/m$^2$, with a Ag laydown of 1.08 g/m$^2$, and a gelatin laydown of 7.32 g/m$^2$.

The coated material was cut into strips; the strips were exposed in a single-grating transmission spectral sensitometer designed to create wedge spectrograph exposures. (Such exposures are well-known in the art; see, for example, "Use of Spectral Sensitizing Dyes to Estimate Effective Energy Levels of Silver Halide Substrates", by P. B. Gilman, Jr., in *Photographic Science and Engineering*, Volume 18, Number 5, September/October 1974.) They were then processed in a KODAK RP-XOMAT processing machine.

Strips used to demonstrate retained sensitizing dye stain for the comparative and inventive dyes were processed without exposure, and the retained dye stain was measured on a scanning spectrophotometer equipped with an integrating sphere.

The metrics which serve as column headings in Table 5 are based on the wedge spectrographic exposures described above, and are defined as follows:

"PEAK" is the approximate wavelength of maximum spectral sensitivity of the dyed emulsion.

"D400" is the difference between the intrinsic speed of the dyed emulsion at 400 nm minus the intrinsic speed of the undyed emulsion at 400 nm. For example, a negative D400 indicates the dye desensitizes the emulsion.

"SRATIO" is the speed of the dyed emulsion at its PEAK wavelength, minus its intrinsic speed at 400 nm, plus 200. For example, an SRATIO of greater than 200 indicates the dye's peak speed was greater than the intrinsic speed.

"SUM" is D400+SRATIO. This yields a measure of how fast the dye's peak speed is compared to the intrinsic speed of an undyed emulsion.

"Dmin" has the usual definition as known in the art.

"STAIN" is measured as described above, and is Beer's Law absorbance.

The data from this experiment appears in Table 5 below:

TABLE 5

| CDye = Comparative Dye | | | IDye = Inventive Dye | | | |
|---|---|---|---|---|---|---|
| Dye | Peak | D400 | SRatio | Sum | Dmin | Stain |
| CDye H | 630 | 26 | 207 | 233 | 0.09 | 0.02 |
| CDye A | 660 | 1 | 216 | 217 | 0.08 | 0.45 |
| CDye I | 680 | −24 | 158 | 134 | 0.10 | 0.033 |
| CDye B | 700 | −28 | 120 | 92 | 0.05 | 0.02 |
| CDye C | 630 | 23 | 230 | 253 | 0.07 | 0.05 |
| CDye D | 610 | 39 | 236 | 275 | 0.07 | 0.032 |
| CDye E | 640 | −26 | 225 | 199 | 0.08 | 0.65 |
| CDye G | 670 | −36 | 211 | 175 | 0.13 | 0.35 |
| CDye F | 620 | 6 | 259 | 265 | 0.07 | 0.48 |
| IDye 1 | 640 | 37 | 183 | 220 | 0.18 | 0.025 |
| IDye 6 | 640 | −11 | 133 | 122 | 0.08 | 0.000 |
| IDye 22 | 620 | 25 | 53 | 78 | 0.11 | 0.000 |
| IDye 21 | 630 | 15 | 97 | 112 | 0.07 | 0.000 |
| IDye 16 | 630 | 22 | 82 | 104 | 0.06 | 0.000 |
| IDye 24 | 630 | 8 | 120 | 128 | 0.11 | 0.000 |
| IDye 23 | 620 | 12 | 124 | 136 | 0.06 | 0.000 |
| IDye 7 | 630 | 17 | 49 | 66 | 0.05 | 0.000 |
| IDye 12 | 660 | −27 | 127 | 100 | 0.06 | 0.000 |
| IDye 11 | 660 | 6 | 126 | 132 | 0.06 | 0.008 |
| IDye 3 | 640 | 12 | 169 | 181 | 0.07 | 0.010 |
| IDye 2 | 640 | 5 | 135 | 140 | 0.06 | 0.006 |
| IDye 8 | 580 | 10 | 78 | 88 | 0.07 | 0.000 |
| IDye 27 | 640 | 5 | 172 | 177 | 0.06 | 0.006 |

The data in Table 5 above demonstrate that the inventive dyes function as spectral sensitizing dyes, that in a preferred embodiment they are about as effective as the comparative dyes, which are representative of red spectral sensitizing dyes as typically employed in the practice of spectral sensitization for photographic elements, and that they possess the additional desirable feature of being substantially lower in retained dye stain than the comparative dyes.

Example 3; AgBr Cube in Photothermographic Composition

In this example, inventive sensitizing dyes and a comparative sensitizing dye were used to spectrally sensitize photothermographic elements.

The composition was prepared by combining the following components in the order given.

| Component | Weight |
|---|---|
| silver behenate dispersion in methylisobutylketone (MIBK) (5.0% by weight BUTVAR ® B-76 poly (vinylbutaral) available from the Monsanto Co., USA, 0.20% by weight sodium iodide, 4.25% by weight Ag, 0.0096% by weight $HgBr_2$) | 38.0g |
| silver bromide emulsion (4.2% by weight Ag as cubic AgBr with 85 nm edgelength in 11% by weight BUTVAR ® B-76 in MIBK) | 15.2g |
| succinamide (10% by weight in 10.5% by weight acetone solution of BUTVAR ® B-76) | 7.0g |
| SF-96 ® (10% by weight in MIBK, SF-96 ® is a silicone surfactant available from General Electric Co., USA) | 0.3g |
| 2-bromo-2-(4-methylphenylsulphonyl) acetamide (2.5% by weight in 10.5% by weight acetone solution of BUTVAR ® B-76) | 4.6g |
| 2,4-bis(tricloromethyl)-6-(1-naphthyl-s-triazine (2.5% by weight in 10.5% by weight acetone solution of BUTVAR ® B-76) | 1.1g |
| sensitizing dye (0.209 mmol of a sensitizing dye in 12.5% by weight phenoxyethanol in acetone solution) | 8.5g |
| benzenesulfonamidophenol (10% by weight in 10.5% by weight acetone solution of BUTVAR ® B-76) | 18.7g |
| MIBK | 6.6g |

The above photothermographic compositions were coated on a mechanical roll coating machine on an ESTAR base with a total laydown of 69 cc/$m^2$ and a Ag laydown of 1.14 g/$m^2$ (0.38 g/$m^2$ Ag from AgBr and 0.96 g/$m^2$ Ag from silver behenate). The element was overcoated with the following composition at 69 cc/$m^2$.

water 40.82 g

| | |
|---|---|
| Elvanol PVA in water (8% by weight solids) | 33.40g |
| PSA solution | 24.48g |
| surfactant | 1.00g |
| matte bead | 0.30g |

The PSA solution used in the overcoat was made by combining 172.8 g of water, 7.2 g 1N p-toluenesulfonic acid, and 200 g methanol. To this mixture, 208 g of TEOS was added and the mixture was stirred until cooled to room temperature.

The coated material was slit into strips; the strips were exposed for $10^{-3}$ seconds by an EG&G sensitometer through a stepwedge and through a Wrattan 29 filter. The exposed strips were processed at 119° C. for 5 seconds. The Ag image densities were measured using a blue filter in a computer densitometer.

Keeping stability was measured by incubating at 120° F. and 15% by weight relative humidity for 2 weeks to accelerate aging. These strips were exposed and processed as described above. The results are summarized in Table 6 below:

TABLE 6

| | Stepwedge | Dmin | Dmax | Speed | Δ Speed 2 Weeks 120° C./RH15 |
|---|---|---|---|---|---|
| Dye H | 630 | 0.16 | 3.57 | 310 | −16 |
| Dye 1 | 630 | 0.2 | 3.24 | 287 | −8 |
| Dye 2 | 630 | 0.16 | 3.21 | 280 | −5 |
| Dye 3 | 620 | 0.17 | 3.31 | 263 | −11 |

The data in Table 6 demonstrate that the inventive dyes function as spectral sensitizing dyes, that in a preferred embodiment they are about as effective as the comparative dye, which is representative of red spectral sensitizing dyes as typically employed in the practice of spectral sensitization for photographic elements, and that they possess the additional desirable feature of giving a photographic element that is substantially more stable on keeping.

While the invention has been described in detail with particular reference to preferred embodiments, it will be understood that variations and modifications can be effected within the spirit and scope of the invention.

We claim:

1. A photographic element comprising a silver halide emulsion sensitized by dye of the formula I:

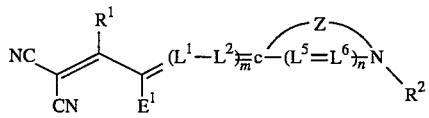

I wherein:

$R^1$ represents a substituted or unsubstituted aromatic or heteroaromatic group, an aralkyl group, a substituted or unsubstituted alkyl or H, wherein the substituents of the substituted aromatic or heteroaromatic group and the substituted alkyl are selected from halogen, alkoxy, acyl, alkyl, alkoxycarbonyl, aminocarbonyl, carbonamido, carboxy, sulfamoyl, sulfonamido, sulfo, nitro, hydroxy, amino, or cyano;

$R^2$ represents a substituent or unsubstituted alkyl, alkenyl, aryl, aralkyl, or H, wherein the substituents of the substituted alkyl, alkenyl, aryl or arakyl are selected from halogen, alkoxy, acyl, alkyl, alkoxycarbonyl, aminocarbonyl, carbonamido, carboxy, sulfamoyl, sulfonamido, sulfo, nitro, hydroxy, amino, cyano or sulfato;

$E^1$ represents an electron withdrawing group;

Z represents the non-metallic atoms required to complete a ring system containing at least one 5- or 6-membered heterocyclic nucleus;

$L^1$, $L^2$, $L^5$ and $L^6$ independently represent a substituted or unsubstituted methine, wherein the substituents of the substituted methine are selected from alkyl, alkenyl, aryl, aralkyl, halogen, acetoxy, acyl, cyano, carbonamido, alkoxycarbonyl, alkoxy or aminocarbonyl;

m may be 0, 1, 2 or 3;

n may be 0 or 1.

2. A photographic element according to claim 1 wherein said dye is of formula Ia:

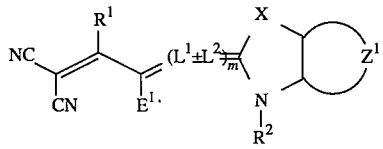

Ia wherein: X is O, N, S, Se, Te; $Z^1$ represents the atoms necessary to complete a substituted or unsubstituted benzene or naphthalene ring, wherein the substituents of the substituted benzene or naphthalene ring are selected from halogen, alkoxy, acyl, alkyl, alkoxycarbonyl, aminocarbonyl, carbonamido, carboxy, sulfamoyl, sulfonamido, sulfo, nitro, hydroxy, amino, cyano or a 5 or 6 membered heterocyclic ring; and wherein $R^1$, $E^1$, $L^1$, $L^2$, m, and $R^2$ are as defined in claim 1.

3. A photographic element according to claim 2 wherein said dye is of the formula Ib:

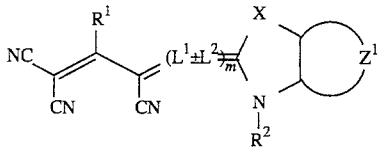

Ib.

wherein: X is O, N, S, Se, Te; $Z^1$ represents the atoms necessary to complete a substituted or unsubstituted benzene or naphthalene ring, wherein the substituents of the substituted benzene or naphthalene ring are selected from halogen, alkoxy, acyl, alkyl, alkoxycarbonyl, aminocarbonyl, carbonamido, carboxy, sulfamoyl, sulfonamido, sulfo, nitro, hydroxy, amino, cyano or 5 or 6 membered heterocyclic ring; and wherein $R^1$, $L^1$, $L^2$, m, and $R^2$ are as defined in claim 1.

4. A photographic element according to claim 3 wherein; X is O or S and; $Z^1$ represents the atoms necessary to complete, together with the ring containing X and N, a substituted or unsubstituted benzoxazole, naphthoxazole, benzothiazole, or naphthothiazole, in which the substituents of the substituted benzene or naphthalene are selected from halogen, alkoxy, acyl, alkyl, alkoxycarbonyl, aminocarbonyl, carbonamido, carboxy, sulfamoyl, sulfonamido, sulfo, nitro, hydroxy, amino, cyano or a 5 or 6 membered heterocyclic ring.

5. A photographic element according to claim 3 wherein: X is O and; $Z^1$ completes a substituted or unsubstituted benzene or naphthalene, in which the substituents are selected from halogen, alkoxy, acyl, alkyl, alkoxycarbonyl, aminocarbonyl, carbonamido, carboxy, sulfamoyl, sulfonamido, sulfo, nitro, hydroxy, amino, cyano or a 5 or 6 membered heterocyclic ring.

6. A photographic element according to claim 1 wherein $R^1$ is substituted or unsubstituted phenyl or thiophene, wherein the substituents of the substituted phenyl or thiophene are selected from halogen, alkoxy, acyl, alkyl, alkoxycarbonyl, aminocarbonyl, carbonamido, carboxy, sulfamoyl, sulfonamido, sulfo, nitro, hydroxy, amino, or cyano.

7. A photographic element according to claim 3 wherein $R^1$ is substituted or unsubstituted phenyl or thiophene, wherein the substituents of the substituted phenyl or thiophene are selected from halogen, alkoxy, acyl, alkyl, alkoxycarbonyl, aminocarbonyl, carbonamido, carboxy, sulfamoyl, sulfonamido, sulfo, nitro, hydroxy, amino, or cyano.

8. A photographic element according to claim 1 wherein the dye has at least one acid or acid salt group.

9. A photographic element according to claim 3 wherein the dye has at least one acid or acid salt group.

10. A photographic element according to claim 3 wherein m is 2.

11. A photographic element according to claim 3 wherein each L is unsubstituted methine.

12. A photographic element according to claim 3 wherein the dye has at least one carboxy, sulfonamido, sulfamoyl, sulfato or sulfo substituent.

13. A photographic element according to claim 3 wherein $R^2$ is an alkyl substituted with a carboxy, sulfonamido, sulfamoyl, sulfato or sulfo substituent.

14. A photographic element according to claim 3 wherein: m is 2; $R^2$ is substituted or unsubstituted alkyl, wherein the substituents of the substituted alkyl are selected from halogen, alkoxy, acyl, alkyl, alkoxycarbonyl, aminocarbonyl, carbonamido, carboxy, sulfamoyl, sulfonamido, sulfo, nitro, hydroxy, amino, cyano or sulfato, and; $R^1$ is substituted or unsubstituted phenyl, wherein the substituents of the substituted phenyl are selected from halogen, alkoxy, acyl, alkyl, alkoxycarbonyl, aminocarbonyl, carbonamido, carboxy, sulfamoyl, sulfonamido, sulfo, nitro, hydroxy, amino, or cyano.

15. A photographic element according to claim 3 wherein $Z^1$ has as a substituent, a 5 or 6 membered heterocyclic ring.

16. A photographic element according to claim 15 wherein the heterocyclic ring is a pyrrole or furan ring.

17. A photographic element according to claim 1 wherein the dye of formula (I) which sensitizes the silver halide, is not also present in the element as a solid particle filter dye.

18. A photographic element according to claim 2 wherein the dye of formula (I) which sensitizes the silver halide, is not also present in the element as a solid particle filter dye.

19. A photographic element according to claim 3 wherein the dye of formula (I) which sensitizes the silver halide, is not also present in the element as a solid particle filter dye.

20. A photographic element according to claim 4 wherein the dye of formula (I) which sensitizes the silver halide, is not also present in the element as a solid particle filter dye.

* * * * *

UNITED STATES PATENT AND TRADEMARK OFFICE

CERTIFICATE OF CORRECTION

PATENT NO. : 5,464,736
DATED : November 7, 1995
INVENTOR(S) : Margaret J. Helber, et al It is certified that error appears in the above-indentified patent and that said Letters Patent is hereby corrected as shown below:

In the Abstract, Formula I, line 3

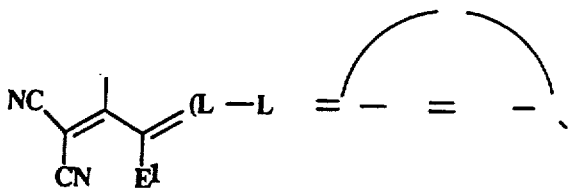

I should read

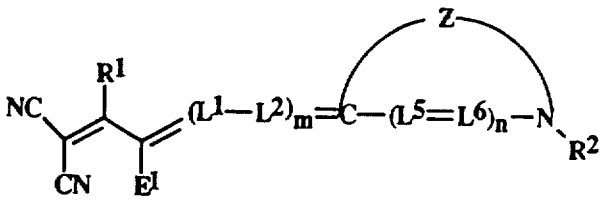

I

UNITED STATES PATENT AND TRADEMARK OFFICE

CERTIFICATE OF CORRECTION

PATENT NO. : 5,464,736
DATED : November 7, 1995
INVENTOR(S) : Margaret J. Helber, et al It is certified that error appears in the above-indentified patent and that said Letters Patent is hereby corrected as shown below:

In column 4, line 1

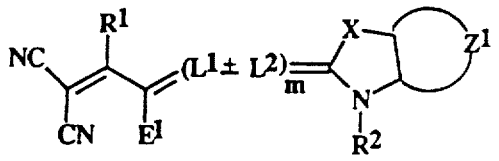

Ia should read

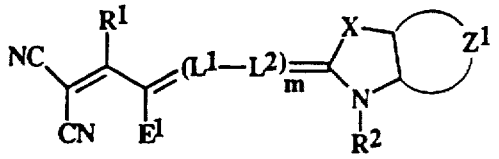

Ia

UNITED STATES PATENT AND TRADEMARK OFFICE

CERTIFICATE OF CORRECTION

PATENT NO. : 5,464,736
DATED : November 7, 1995
INVENTOR(S) : Margaret J. Helber, et al It is certified that error appears in the above-indentified patent and that said Letters Patent is hereby corrected as shown below:

In column 4, line 15

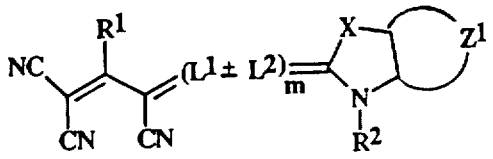

Ib should read

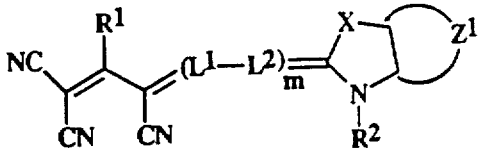

Ib

UNITED STATES PATENT AND TRADEMARK OFFICE

CERTIFICATE OF CORRECTION

PATENT NO. : 5,464,736
DATED : November 7, 1995
INVENTOR(S) : Margaret J. Helber, et al It is certified that error appears in the above-indentified patent and that said Letters Patent is hereby corrected as shown below:

In Claim 2, column 20, line 50

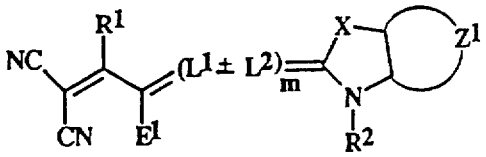

Ia should read

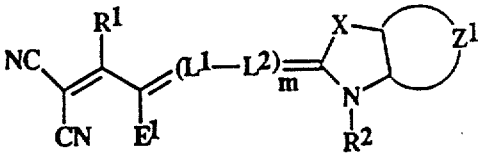

Ia

UNITED STATES PATENT AND TRADEMARK OFFICE

CERTIFICATE OF CORRECTION

PATENT NO. : 5,464,736
DATED : November 7, 1995
INVENTOR(S) : Margaret J. Helber, et al It is certified that error appears in the above-indentified patent and that said Letters Patent is hereby corrected as shown below:

In Claim 3, column 21, line 1

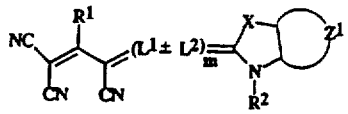

Ib should read

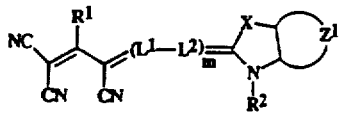

Ib

Signed and Sealed this

Seventh Day of May, 1996

Bruce Lehman

BRUCE LEHMAN

*Commissioner of Patents and Trademarks*

*Attest:*

*Attesting Officer*